US007839093B2

(12) United States Patent
Kästle et al.

(10) Patent No.: US 7,839,093 B2
(45) Date of Patent: Nov. 23, 2010

(54) CIRCUIT ARRANGEMENT WITH CONTINUOUSLY OSCILLATING MODULATED OPERATING FREQUENCY, AND METHOD, FOR THE OPERATION OF HIGH-PRESSURE GAS DISCHARGE LAMPS

(75) Inventors: Herbert Kästle, Traunstein (DE); Thomas Rossmanith, München (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 154 days.

(21) Appl. No.: 12/085,296

(22) PCT Filed: Nov. 30, 2006

(86) PCT No.: PCT/EP2006/069152

§ 371 (c)(1),
(2), (4) Date: May 21, 2008

(87) PCT Pub. No.: WO2007/068603

PCT Pub. Date: Jun. 21, 2007

(65) Prior Publication Data

US 2008/0284345 A1 Nov. 20, 2008

(30) Foreign Application Priority Data

Dec. 14, 2005 (DE) ..... 10 2005 059 762

(51) Int. Cl.
*H05B 37/02* (2006.01)

(52) U.S. Cl. ..... 315/224; 315/209 R; 315/194; 315/246; 315/291

(58) Field of Classification Search ..... 315/209 R, 315/247, 246, 224, 225, 219, 291, 297, 307–311, 315/194

See application file for complete search history.

(56) References Cited

U.S. PATENT DOCUMENTS 6,803,730 B2 * 10/2004 Nadd et al. ..... 315/209 R
7,034,800 B2 * 4/2006 Nakatsuka et al. ..... 345/102
2005/0285544 A1 12/2005 Kastle

FOREIGN PATENT DOCUMENTS

EP 0 744 883 A1 11/1996
EP 1 501 338 A2 1/2005

OTHER PUBLICATIONS

Stormberg H-P et al: "Excitation of Acoustic Instabilities in Discharge Lamps with Pulsedsupply Voltage" Lighting Research and Technology, Illuminating Engineering Society, London, GB, vol. 15, No. 3, Mar. 1983, pp. 127-132, XP002052920 ISSN: 0024-3426 the whole document.

* cited by examiner

*Primary Examiner*—Tuyet Thi Vo
(74) *Attorney, Agent, or Firm*—Holtz, Holtz, Goodman & Chick, P.C.

(57) ABSTRACT

Disclosed is a circuit arrangement for supplying a lamp wattage to a high-pressure discharge lamp (Lp) in the form of an alternating current having an operating frequency. The alternating current is generated by a full bridge that is composed of two half-bridge branches. The lamp wattage can be adjusted via the phase which the two half-bridge branches have relative to each other. The lamp wattage is modulated by means of the transmission function of an interface if the operating frequency is frequency-modulated. Said modulation of the lamp wattage can be compensated by adequately correcting the phase.

11 Claims, 4 Drawing Sheets

CIRCUIT ARRANGEMENT WITH CONTINUOUSLY OSCILLATING MODULATED OPERATING FREQUENCY, AND METHOD, FOR THE OPERATION OF HIGH-PRESSURE GAS DISCHARGE LAMPS

TECHNICAL FIELD

The invention relates to a circuit arrangement for operating high-pressure gas discharge lamps. In the text which follows, high-pressure gas discharge lamps will also be called lamps in brief. Furthermore, the invention relates to a method for operating such lamps. Descriptions relating to advantageous embodiments of the circuit arrangement correspondingly also apply to the method. In particular, the invention deals with operating the lamps with modulated operating frequency.

PRIOR ART

In the operation of high-pressure gas discharge lamps, there is often a need for modulating the operating frequency. In most cases, the modulation is intended to prevent acoustic resonances in the lamp. There are also cases in which acoustic resonances are selectively excited by the modulation in order to thoroughly mix the gas filling of the lamp.

Acoustic resonances are a familiar problem in the operation of high-pressure gas discharge lamps. Depending on the geometry and on the pressure in the lamp, these resonances occur in a frequency range between 5 kHz and 1000 kHz and can lead to arc irregularity and even to the destruction of the lamp in the case of distinct resonances. Operating a lamp with an alternating current which has a frequency in the said frequency range is therefore not absolutely reliable.

A circuit arrangement for operating a high-pressure gas discharge lamp generally comprises an inverter which provides a high-frequency alternating voltage which has an operating frequency which has a range between 10 kHz and 10 MHz. It is known that the inverter can be constructed as full bridge which is fed by a direct voltage. This is described in the following document: Bill Andreycak, "Phase Shifted Zero Voltage Transition Design Considerations and the UC3875 PWM Controller", Unitrode Application Note U-136A, 1997. The full bridge has a bridge branch which is in each case fed by a half-bridge branch at the ends. The voltages which the half-bridge branches have with respect to one another have a phase with respect to one another. If the phase is 180 degrees or Π, respectively, the amplitude of the voltage present at the bridge branch is maximum and has a value which corresponds to a supply voltage which feeds the full bridge. If the phase is zero, the amplitude is also zero. In the abovementioned document, it is described how the voltage at the bridge branch, and thus the output voltage of the inverter, can be controlled by means of the phase.

The lamp is coupled to the output of the inverter via a coupling network. The coupling network is generally a reactance network and has a transfer function which describes the lamp current in dependence on the operating frequency at a given output voltage of the inverter:

In the above formula, stands for the amplitude of the lamp current, ω stands for the angular frequency of the operating frequency, stands for the amplitude of the output voltage of the inverter and stands for the transfer function of the coupling network.

If the operating frequency is then modulated for one of the above reasons, this leads to an amplitude modulation of the lamp current due to the transfer function. This can lead to unwanted flickering phenomena and arc irregularities.

DESCRIPTION OF THE INVENTION

It is the object of the present invention to provide a circuit arrangement for operating high-pressure discharge lamps which exhibits a modulated operating frequency and does not cause any flickering phenomena or arc irregularities in a connected lamp.

This object is achieved by a circuit arrangement which exhibits the following features:

- a full-bridge inverter comprising two half-bridge branches and an intermediate bridge branch, wherein a half-bridge voltage can be fed into the bridge branch through each half-bridge branch,
- the half-bridge voltages exhibit a phase with respect to one another which can be set by a controller,
- the high-pressure gas discharge lamp can be coupled to the bridge branch,
- the full-bridge inverter supplies to the high-pressure gas discharge lamp a lamp current which is essentially an alternating current with a modulated operating frequency which continuously oscillates within a range between a minimum frequency and a maximum frequency,
- the controller sets the phase in dependence on the operating frequency in such a manner that the phase increases with increasing operating frequency.

The distinctness of the resonance points of the lamp generally decreases with increasing frequency. I.e., at low frequencies, it is critical if the lamp is provided with a large amount of energy since strong resonances can form. At higher frequencies, in contrast, the lamp can be fed with more energy since the resonances are less distinct there.

The coupling network generally has a low-pass characteristic. I.e. the lamp is fed with more energy at low frequencies than at high frequencies. The invention is then based on the finding that the frequency-dependence of the coupling network can trigger the instability of the lamp because it is especially those frequencies at which strong resonances occur which are less damped. It follows from this finding that the frequency-dependence of the coupling network must be compensated for. According to the invention, this is done by controlling the phase in synchronism with the operating frequency. In a circuit arrangement according to the invention, the phase thus has a modulation like the operating frequency. In the time domain, the frequency-dependence of the coupling network causes a dropping amplitude of the lamp current with increasing frequency. In the frequency domain, the frequency-dependence of the coupling network appears in the power spectrum of the lamp power in such a manner that the spectral power density decreases towards high frequencies. The modulation of the phase according to the invention has the result that the amplitude of the lamp current is approximately independent of the operating frequency or even increases towards higher frequencies. In the frequency domain, the invention has the result that the power spectrum of the lamp power is uniformly distributed or even increases towards higher frequencies.

Apart from the instability of the lamp, the frequency range swept by the operating frequency results in a further problem. Without modulation of the phase according to the invention, the frequency-dependence of the coupling network produces an amplitude modulation of the lamp current. Without countermeasure, this leads to an unwanted flickering of the light flux with the modulation frequency.

It is also advantageous if the modulation of the phase is stronger than would be necessary for compensating for the frequency modulation of the operating frequency. In that case, there is overcompensation. This case can be subdivided into two cases, each of which has its own advantages.

It has hitherto been assumed that the variation with time of the operating frequency is selected in such a manner that all possible operating frequencies between the maximum frequency and the minimum frequency are essentially generated by the inverter for an equal length of time. In this case, overcompensation has the effect that, with increasing operating frequency, more energy is coupled into the lamp. This has an advantageous effect on the stability of the lamp operation since resonance points of the lamp tend to be damped more strongly with increasing frequency. Thus, the lamp converts more energy at operating frequencies at which the resonance points of the lamp are more strongly damped.

If the prerequisite that all possible operating frequencies between the maximum frequency and the minimum frequency are essentially generated by the inverter for an equal length of time no longer applies, overcompensation can be neutralized and this is possible by means of a suitable distribution of the operating frequencies with time. If the period in which the inverter generates a particular operating frequency suitably decreases with increasing frequency, the power spectrum of the lamp power can be essentially uniform at all operating frequencies in spite of an overcompensation. I.e., the switching transistors of the inverter are clocked at high frequencies for a shorter time than would be the case without overcompensation. This leads to a reduction in switching losses in the switching transistors. High frequencies are understood to be frequencies which are closer to the maximum frequency than to the minimum frequency. Overcompensation can thus be utilized for stabilizing the lamp operation or for improving the efficiency of the circuit arrangement. Mixed forms are also possible in which both advantages are utilized by neutralizing the overcompensation only partially by means of a distribution of the operating frequencies with time.

The operating frequency does not need to be modulated periodically with a modulation frequency. The modulation can be controlled, for example, by a noise generator or by chaos.

The relationship between operating frequency and phase defines a modulator characteristic. In the simplest case, the modulator characteristic establishes a linear relationship with a modulation factor between operating frequency and phase. A required frequency deviation of the operating frequency results in a necessary modulation of the phase with a given coupling network in order to meet the above-mentioned condition of compensation. Accordingly, the modulation factor must be set in such a manner that the condition of compensation is met. The variation of the operating frequency with time is preferably triangular or sawtooth-shaped. With a linear modulator characteristic, the variation of the phase with time is then also triangular or sawtooth-shaped.

In dependence on a modulator characteristic, a different frequency variation of the power or power density spectrum of the lamp power is obtained. Since generally a uniformly distributed power spectrum is required, the modulator characteristic is designed in such a manner that it is achieved. Control of the phase by the modulator can be extended to become closed-loop control of the phase. For this purpose, the modulator needs a measurement input which is fed with a measured quantity for the amplitude of the lamp current or the power of the lamp. Depending on the measured quantity, the modulator adjusts its modulator characteristic or its modulation factor in such a manner that the measured quantity remains constant.

There are metal halogen high-pressure lamps with a wattage of 20 W, 35 W, 70 W, 150 W and higher on the market. For 20 W lamps, a minimum frequency of 400 kHz and a maximum frequency of 500 kHz have been found to be advantageous. For 35 W lamps, a minimum frequency of 300 kHz and a maximum frequency of 400 kHz have been found to be advantageous. For 70 W lamps, a minimum frequency of 220 kHz and a maximum frequency of 320 kHz have been found to be advantageous. For 150 W lamps, a minimum frequency of 160 kHz and a maximum frequency of 260 kHz have been found to be advantageous. The frequency values specified are only intended to be examples of dimensioning. If an operating device is intended to be suitable for a number of lamps having different nominal wattage, a compromise must be selected in deviation from the respective optimum frequency range.

For lamps, in which a resonance is to be excited by the modulation of the operating frequency in order to produce a selective thorough mixing of the gas filling, a minimum frequency of 45 kHz and a maximum frequency of 55 kHz have been found to be advantageous.

It is of advantage to the stability of the lamp operation if the spectral power density of the lamp power is reduced. If the average lamp power is intended to remain constant, the power spectrum must be extended for this purpose. To extend the power spectrum in which power is supplied to the lamp, without changing the minimum or maximum frequency, the inverter superimposes on the lamp current a DC component, the sign of which changes with an alternating frequency which is lower than one tenth of the minimum frequency. The DC component is advantageously generated by a full-bridge inverter, the switches of which have a duty ratio which deviates from 50%. The half-bridge branches of the full bridge in each case comprise a first and a second switch. If a first on-time of the first switch is equal to a second on-time of the second switch, the full-bridge inverter generates a square wave voltage without DC component. If the first on-time is reduced by an asymmetry time whereas the second on-time is extended by this asymmetry time, the alternating voltage generated by the full-bridge inverter contains a DC component. To avoid unilateral loading of the lamp, the asymmetry time is alternately subtracted from and added to the first and the second on-time with the alternating frequency. The change in asymmetry does not need to be abrupt. Lower loading on the components used is obtained if the change from subtracting to adding the asymmetry time is continuous. For example, the variation of the value of asymmetry times with time can be triangular. At each point in time, the sum of the asymmetry times of the first and of the second switch is zero.

Without DC component, the power spectrum of the lamp power comprises components in a frequency range between twice the minimum frequency and twice the maximum frequency. Adding the DC component additionally produces components in a frequency range between the minimum frequency and the maximum frequency. Components above twice the maximum frequency are also produced which, however, generally do not play a role with regard to a stable lamp operation. If twice the minimum frequency is greater than the maximum frequency, a spectral gap is produced between the maximum frequency and twice the minimum frequency, in which no power is delivered to the lamp. The minimum frequency and the maximum frequency are advantageously selected in such a manner that particularly distinct resonances of the lamp fall within this spectral gap.

BRIEF DESCRIPTION OF THE DRAWINGS

In the text which follows, the invention will be explained in greater detail by means of exemplary embodiments, referring to drawings, in which.

PREFERRED EMBODIMENT OF THE INVENTION

Figure 1:
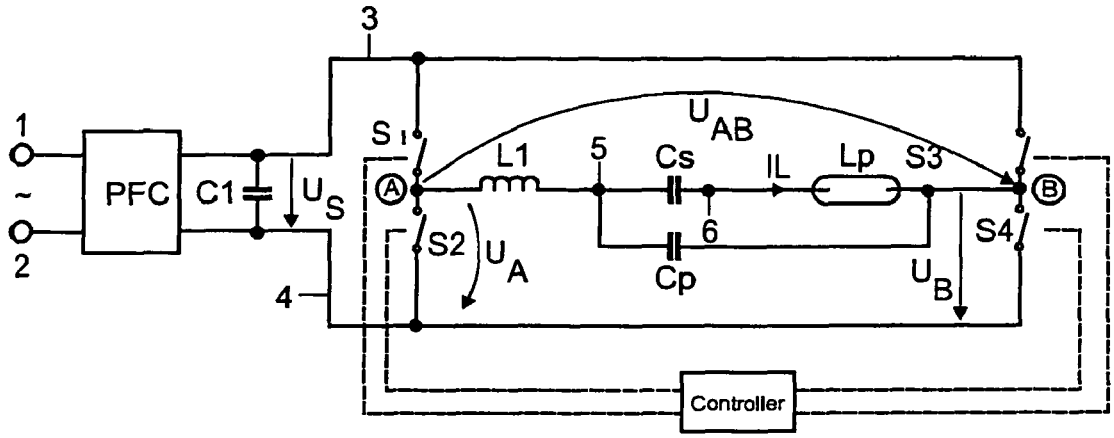
FIG. 1 shows a basic circuit diagram of a circuit arrangement according to the invention.

FIG. 1 shows a basic circuit diagram of a circuit arrangement by means of which the present invention can be implemented. The circuit arrangement has two input terminals 1 and 2, to which a rectified line voltage can be connected. The input terminals 1 and 2 are coupled to a PFC stage which produces power factor correction and provides a supply voltage Us between the potentials 3 and 4. A storage capacitor C1 which is intended to buffer the supply voltage Us is connected in parallel with the supply voltage Us. A potential of the supply voltage is used as reference potential for the circuit arrangement. Without restricting the general applicability, the potential 4 is assumed to be the reference potential in the text which follows.

The supply voltage provides the power supply for a full-bridge inverter. This comprises two half-bridge branches connected in parallel with the supply voltage Us. Each half-bridge branch consists of the series circuit of an upper switch S1, S3 and a lower switch S2, S4. The switches are preferably constructed as MOSFET but can also be constructed as other semiconductor switches. In the case of MOSFETs, the source of the respective upper switch S1, S3 is connected to the drain of the respective lower switch S2, S4 at a junction. The left-hand half-bridge branch has a junction A and the right-hand half-bridge branch has a junction B. At the junctions A and B, a half-bridge voltage with respect to the reference potential is in each case present. The control terminals of the switches are connected to a controller. The controller comprises an oscillator which generates an operating frequency by means of which the control terminals of the switches S1, S2, S3 and S4 are driven. In this arrangement, the switches of a half-bridge branch are driven alternately. In this way, a rectangular alternating voltage UA and UB, respectively, the amplitude of which follows the supply voltage and the respective frequency of which corresponds to the operating frequency, is in each case produced at the junctions A and B with respect to the reference potential. Between the junctions A and B, the bridge branch is located at which a bridge voltage UAB is present. The bridge voltage UAB represents the inverter output voltage of the full-bridge inverter. The RMS value of the bridge voltage UAB can be adjusted via the phase $\phi$ between the voltages UA and UB.

A series circuit consisting of a lamp choke L1 and a parallel capacitor Cp is connected into the bridge branch. The lamp choke L1 and the parallel capacitor Cp are connected at a junction 5. Between the junction 5 and the junction A, the series circuit of a lamp Lp and a series capacitor Cs is connected. The lamp Lp and the series capacitor Cs are connected at a junction 6. The junctions B and 6 can be supplied to terminals at which a lamp can then be connected. The lamp choke L1, the parallel capacitor Cp and the series capacitor Cs form the coupling network. At certain operating frequencies, the parallel capacitor Cp produces an excessive resonance and can be omitted. The series capacitor Cs suppresses DC components in the lamp current IL and can also be omitted. A starting device which provides a high voltage for a short time for starting the lamp is not shown.

The coupling network produces an impedance transformation from the alternating voltage UAB to the lamp. It can also contain a transformer. The impedance transformation of the coupling network has a transfer function which describes the frequency-dependence of the lamp current IL referred to the alternating voltage UAB. In the present case, the transfer function has a band-pass characteristic. With the usual dimensionings, the operating frequency is above the resonant frequency of the transfer function. Above the resonant frequency, the transfer function has a low-pass characteristic.

The controller comprises a modulator with a modulator output. The modulator output is coupled to the oscillator in such a manner that the operating frequency of the modulator can be influenced. The modulator causes the oscillator to generate an operating frequency which continuously oscillates within a range between a minimum frequency and a maximum frequency. In most applications, the variation with time of the operating frequency is periodic with a modulation frequency. A typical value for the modulation frequency is in the 100 Hz range. By means of a suitable choice of modulation frequency, acoustic resonances can be selectively excited in the lamp, for example for thoroughly mixing the gas filling of the lamp or for straightening the discharge arc. If acoustic resonances are to be avoided, the variation with time of the operating frequency can also be non-periodic; e.g. controlled by a noise generator.

The modulator can also be implemented by a microcontroller in which a modulator characteristic for controlling the phase is deposited by a software. The modulator characteristic can also be matched to a lamp to be operated in an optimization process. The modulator characteristic can also take into consideration other frequency-dependent effects which are not based on the coupling network. For example, feed lines or the lamp itself can exhibit a frequency-dependence.

Figure 2:
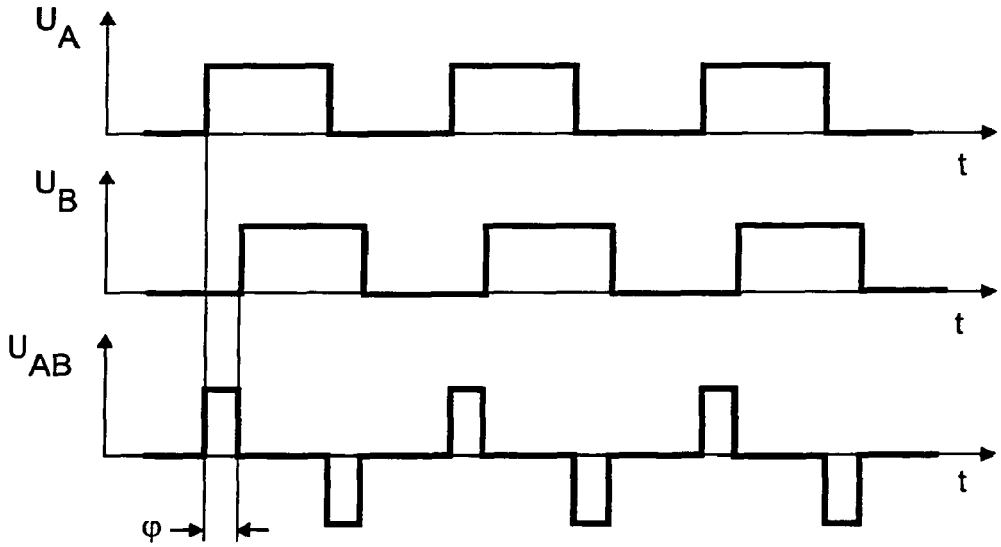
FIG. 2 shows the variation with time of half-bridge voltages and bridge voltage in a full bridge.

FIG. 2 shows the variation with time of voltages of the full-bridge inverter from FIG. 1. Scaling was omitted because it was intended to explain basic relationships. The voltages shown are usually within a range of between 10 V and 500 V. The frequency of the variations with time shown is within the range of the abovementioned ranges for the operating frequency. At the top, the variation with time of the voltage UA is shown. The voltage UA is present between junction A and the reference potential 4. In the center, the variation with time of voltage UB is shown. The voltage UB is present between junction B and the reference potential 4. At the bottom, the variation with time of voltage UAB is shown. The voltage UAB is between junction A and junction B and represents the bridge voltage which is supplied to the lamp via the coupling network.

It can be clearly seen that the voltage UAB is not zero only when the instantaneous voltages UA and UB are different. The phase $\phi$ can thus be used for setting the period for which the supply voltage or the negative supply voltage, respectively, is in each case present at junctions A and B. The RMS value of the voltage UAB can thus be adjusted by the phase $\phi$. For the value of $\phi=0$, the RMS value of the voltage UAB is equal to zero. For the value of $\phi=180$ degrees or $\phi=\Pi$, respectively, the RMS value of the voltage UAB is equal to the value of the supply voltage. If the supply voltage is not constant, this has a proportional effect on the bridge voltage UAB. Fluctuations or a modulation of the supply voltage can be compensated for with the aid of the phase $\phi$. For this purpose, the controller evaluates the supply voltage in such a manner that the phase decreases with increasing supply voltage.

Figure 3:
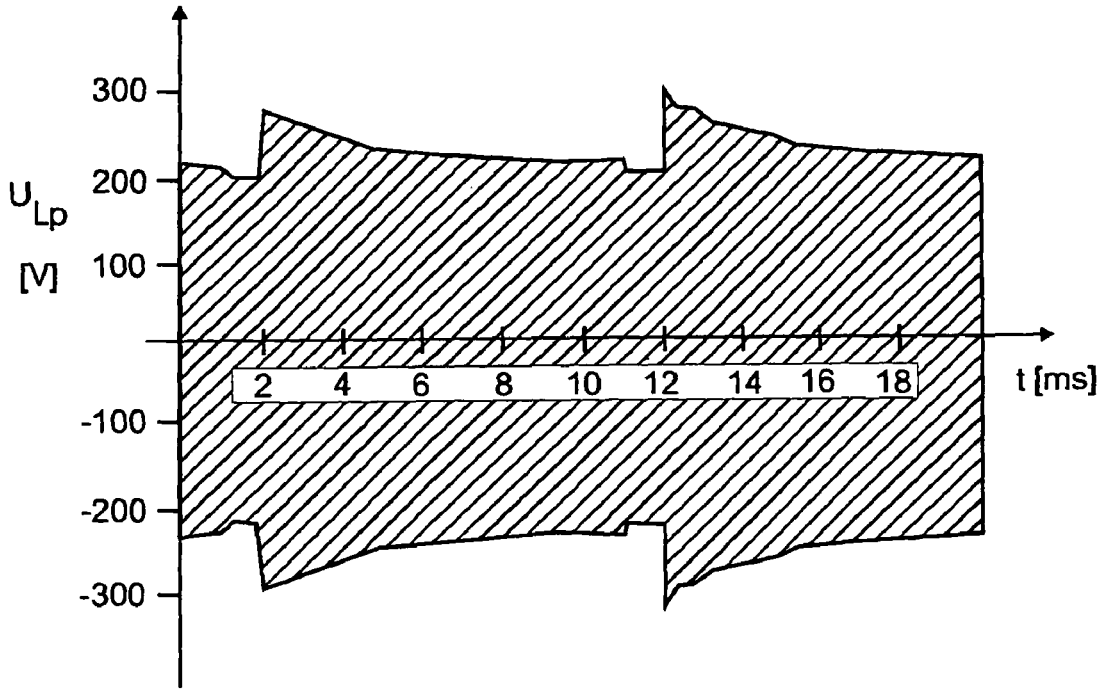
FIG. 3 shows the variation with time of a lamp voltage without compensation for the transfer function of the coupling network.

FIG. 3 shows the variation with time of the envelope of the lamp voltage from FIG. 1, i.e. of the voltage between junctions 6 and B. FIG. 3 shows a variation of the lamp voltage which is known from the prior art. The phase $\phi$ is kept constant and not adapted to the variation with time of the operating frequency in order to compensate for the transfer function of the coupling network. It can be clearly seen how the lamp voltage varies with a frequency of approx. 100 Hz which corresponds to the modulation frequency.

Figure 4:
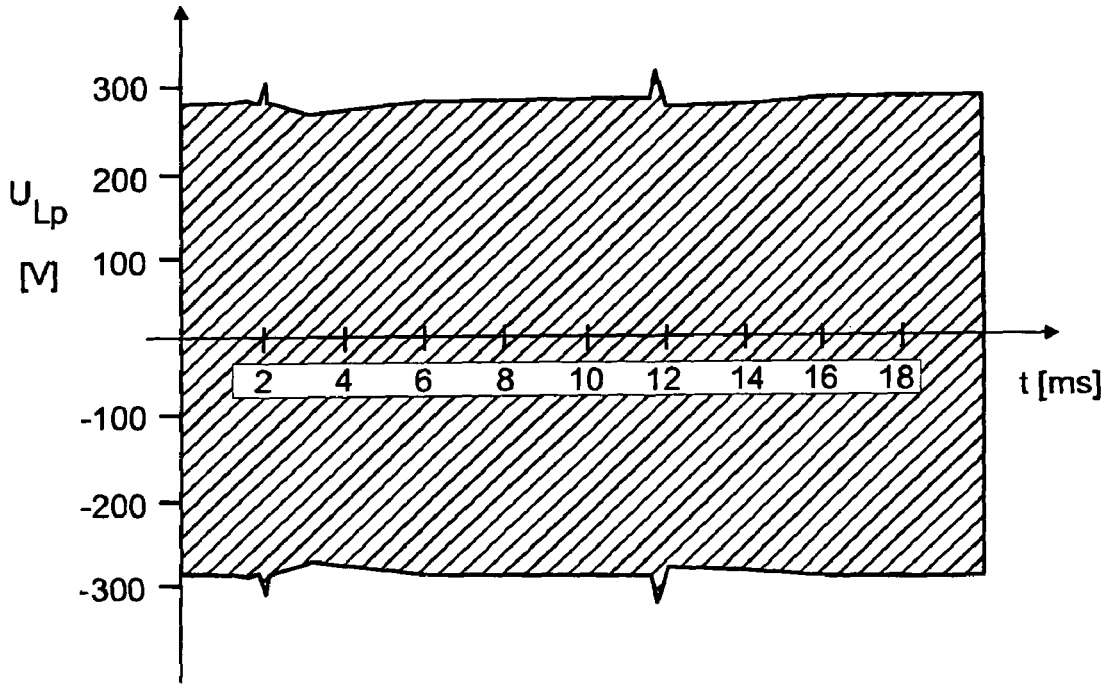
FIG. 4 shows the variation with time of a lamp voltage with compensation for the transfer function of the coupling network.
Figure 5:
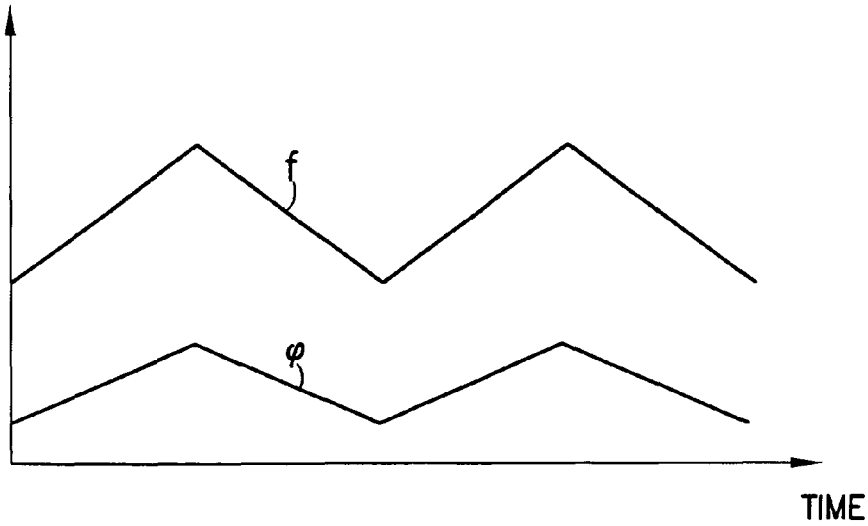
FIG. 5 illustrates the variation of frequency (f) with phase for a triangular supply voltage.
Figure 6:
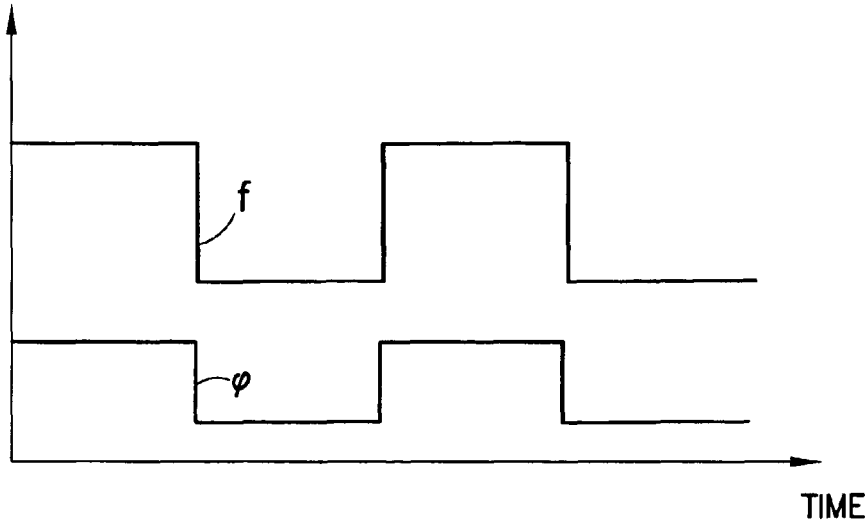
FIG. 6 illustrates the variation of frequency (f) with phase for a sawtooth supply voltage.
Figure 7:
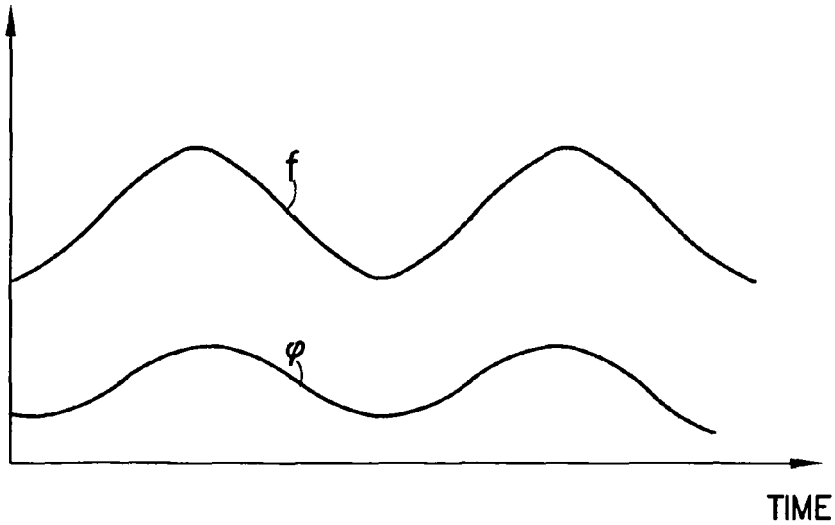
FIG. 7 illustrates the variation of frequency (f) with phase for a sinusoidal supply voltage.
Figure 8:
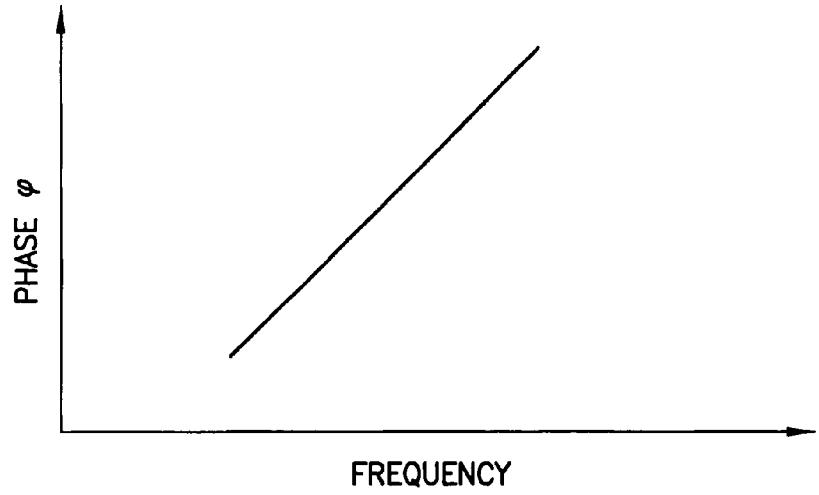
FIG. 8 illustrates the phase increasing with increasing operating frequency.
Figure 9:
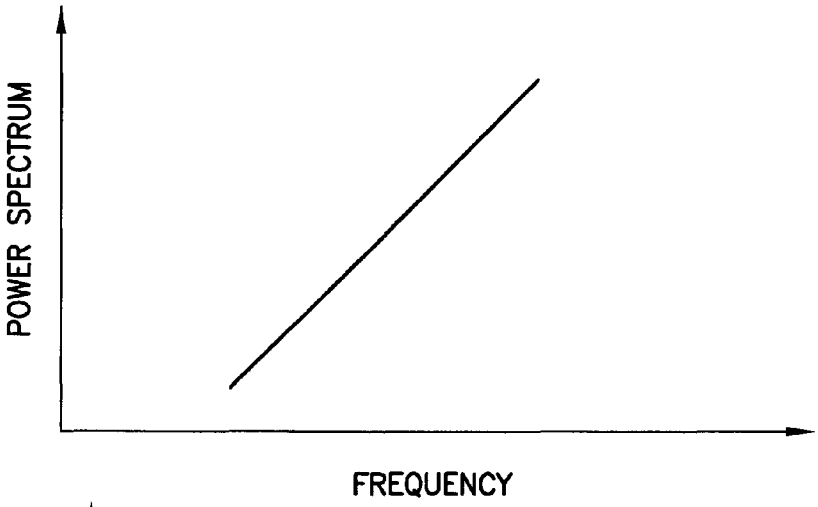
FIG. 9 illustrates the power spectrum increasing with the frequency.
Figure 10:
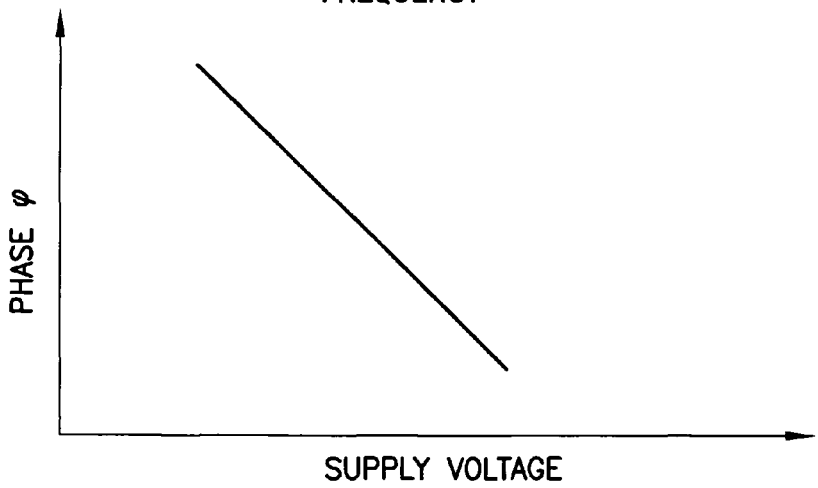
FIG. 10 illustrates phase decreasing with supply voltage.

FIG. 4 also shows the variation with time of the envelope of the lamp voltage from FIG. 1. According to the teaching of the present invention, however, the phase $\phi$ is now adapted to the variation with time of the operating frequency. The adaptation is advantageously selected in such a manner that the transfer function of the coupling network is largely compensated for. Both the lower and the upper limit of the envelope lamp voltage scarcely exhibit fluctuations, in contrast to FIG. 3.

The invention claimed is:

1. A circuit arrangement for operating a high-pressure gas discharge lamp (Lp), the circuit arrangement exhibiting the following features:

a full-bridge inverter (S1, S2, S3, S4) comprising two half-bridge branches and an intermediate bridge branch, wherein a half-bridge voltage (UA, UB) can be fed into the bridge branch through each half-bridge branch;

a supply voltage (US) wherein the supply voltage feeds the full-bridge inverter (S1, S2, S3, S4);

the half-bridge voltages (UA, UB) exhibit a phase ($\phi$) with respect to one another which can be set by a controller, the high-pressure gas discharge lamp (Lp) can be coupled to the bridge branch, the full-bridge inverter (S1, S2, S3, S4) supplies to the high-pressure gas discharge lamp (Lp) a lamp current (IL) which is essentially an alternating current with a modulated operating frequency which continuously oscillates within a range between a minimum frequency and a maximum frequency, the circuit arrangement being characterized in that the controller sets the phase ($\phi$) in dependence on the operating frequency in such a manner that the phase ($\phi$) increases with increasing operating frequency.

2. The circuit arrangement as claimed in claim 1, characterized in that the difference between maximum frequency and minimum frequency is at least 10 kHz.

3. The circuit arrangement as claimed in claim 1, characterized in that the power spectrum of the power of an operated lamp (Lp) is uniformly distributed.

4. The circuit arrangement as claimed in claim 1, characterized in that the variation with time of the phase ($\phi$) is sinusoidal, triangular or sawtooth-shaped.

5. The circuit arrangement as claimed in claim 1, characterized in that the controller evaluates the supply voltage (Us) in such a manner that the phase ($\phi$) decreases with increasing supply voltage.

6. The circuit arrangement as claimed in claim 1, characterized in that the half-bridge branches in each case comprise a first (S1/S3) and a second (S2/S4) electronic switch, wherein the respective first switch (S1/S3) is switched on during a first on-time and the respective second switch (S2/S4) is switched on during a subsequent second on-time.

7. The circuit arrangement as claimed in claim 1, characterized in that each half-bridge branch has two switches (S1/S2, S3/S4) and the controller provides the control signals for the switches (S1, S2, S3, S4) and, furthermore, the controller comprises an oscillator which specifies the operating frequency and a modulator controls the oscillator in such a manner that the operating frequency exhibits a variation with time between the minimum frequency and the maximum frequency and, furthermore, the modulator controls the phase ($\phi$).

8. The circuit arrangement as claimed in claim 7, characterized in that between the full-bridge inverter (S1, S2, S3, S4) and the lamp (Lp), a coupling network (L1, Cs, Cp) is connected which exhibits a transfer function which describes the dependence of the amplitude of the lamp current (IL) on the operating frequency, and, furthermore, the modulator synchronizes the variation with time of the phase ($\phi$) by means of a modulator characteristic to the variation with time of the operating frequency in such a manner that the variation with time of the phase compensates for the effect of the transfer function.

9. The circuit arrangement as claimed in claim 8, characterized in that when the operating frequency assumes the value of the maximum frequency, the phase ($\phi$) assumes the value of 180 degrees or $\Pi$.

10. The circuit arrangement as claimed in claim 7, characterized in that the modulator establishes a linear relationship between phase ($\phi$) and operating frequency.

11. A method for operating high-pressure discharge lamps comprising a full-bridge inverter (S1, S2, S3, S4) with two half-bridge branches and a bridge branch, with the following method steps:

coupling a high-pressure discharge lamp (Lp) to the bridge branch;

the bridge branch is fed by two half-bridge voltages (UA, UB) which are generated by the half-bridge branches;

a phase ($\phi$) which the half-bridge voltages (UA, UB) exhibit with respect to one another is set by a controller, a lamp current (IL) which is supplied by the full-bridge inverter (S1, S2, S3, S4) to the high-pressure gas discharge lamp (Lp) exhibits an operating frequency which is continuously varied within a range between a minimum frequency and a maximum frequency, the method being characterized in that the phase ($\phi$) is set in dependence on the operating frequency in such a manner that the phase ($\phi$) increases with increasing operating frequency.

* * * * *